United States Patent [19]

Moore, III

[11] Patent Number: 4,993,333

[45] Date of Patent: Feb. 19, 1991

[54] SEWING APPARATUS

[76] Inventor: Edgar F. Moore, III, 4447 Old Randleman Rd., Greensboro, N.C. 27408

[21] Appl. No.: 506,921

[22] Filed: Apr. 9, 1990

Related U.S. Application Data

[63] Continuation of Ser. No. 348,943, May 8, 1989, Pat. No. 4,932,341.

[51] Int. Cl.[5] ..... D05C 9/04

[52] U.S. Cl. ..... 112/103; 112/119; 38/102.3

[58] Field of Search ..... 112/102, 103, 121.12, 112/121.15, 119; 38/102.3, 102.91

[56] References Cited

U.S. PATENT DOCUMENTS 4,598,488 7/1986 Inteso ..... 112/103 X

FOREIGN PATENT DOCUMENTS 571419 2/1933 Fed. Rep. of Germany ..... 112/102

2125073 2/1984 United Kingdom ..... 112/103

*Primary Examiner*—Werner H. Schroeder

*Assistant Examiner*—Paul C. Lewis

[57] ABSTRACT

Framing hoop apparatus for use in sewing and embroidering includes a pair of engagable hoops. The inner hoop includes opposingly, outwardly extending flanges having ramp portions and ports for engaging spring-loaded plunger spheres of a hoop receiver. The hoop receiver includes a divider which is "T-shaped" and forms two compartments. The spring-loaded plunger spheres of the receiver are adjustably urged downwardly whereby the spheres will engage the receiving ports of inserted framing hoops to releasably hold them within the receiver during sewing.

14 Claims, 4 Drawing Sheets

SEWING APPARATUS

This is a continuation of application Ser. No. 07/348,943 filed May 8, 1989, now U.S. Pat. No. 4,932,341.

BACKGROUND OF THE INVENTION

1. Field Of The Invention

The present invention relates to apparatus for sewing and specifically for apparatus utilizing a series of sewing stations which are controlled at a central location for simultaneously sewing or stitching a number of large, bulky garments.

2. Description Of The Related Art

It has become standard to provide sewing plant operations with a number of inter-connected and duplicative sewing stations which are controlled and joined to a central location. A conventional controller may for example be a microprocessor having a "punch tape" which will direct a particular stitch or sewing configuration to two (2) or more serially arranged sewing stations simultaneously. It is especially popular in "after market" sewing where seat shirts or the like are purchased from a manufacturer and are then stitched with a specific team or company logo to utilize multi-station sewing apparatus. In such operations, an operator can load two (2) or more individual framing hoops with shirts or other garments, position the hoops on the sewing stations, and then direct the controller to stitch the two (2) or more garments simultaneously with identical patterns or logos in a time and labor efficient manner. In these operations, a microprocessor causes a hoop receiver to move in a particular sewing pattern, and since each sewing station has a hoop receiver affixed to means to drive the hoop, a number of garments can be sewed or stitched with an identical pattern by fixed sewing machines.

However, it is difficult at the present time for such sewing operations to be performed without breakdowns and jams since framing hoops are customarily driven above the cylinder arms of the sewing machines, with the cylinder arms flush with the top of the sewing table over which the hoop drive mechanism slides. Thus, it a sweat shirt is to be stitched with a company logo on the back, the front, arms and other ports of the shirt must be accommodated during the sewing operation and must be kept out of the way of the drive mechanism for the operation to proceeds without a jam occurring. As would be understood, if one operator is in charge of two (2) or more such work stations, a jam at one station will in turn cause all stations to be inoperative thus losing valuable time and often at the expense of two (2) or more garments being discarded. Large, bulky garments frequently cause jams by being compressed between the hoop drive mechanism and the sewing machine, or by being caught between the drive mechanism and the cylinder arm of the sewing machine as it moves on the table.

SUMMARY OF THE INVENTION

Therefore, with the disadvantages and limitations of prior art sewing devices and apparatus, the present invention was conceived and one of its objectives is to provide sewing apparatus which will accommodate large, bulky garments during multi-station sewing with ease and convenience.

It is also an objective of the present invention to provide sewing apparatus comprising a sewing station having a sewing machine head and cylinder arm raised above the table whereby excess portions of the garment can be maintained below and around the cylinder arm, out of the way of the hoop drive mechanism.

It is still another objective to provide a sewing station having a framing hoop which is attached to a hoop drive mechanism positioned on the sewing table, below the cylinder arm.

It is yet another objective of the present invention to provide sewing apparatus comprising a plurality of raised, serially joined sewing stations and having means to drive a plurality of framing hoops simultaneously.

It is also an objective of the present invention to provide a framing hoop with an inner hoop alignment flange which is easily inserted and released from a hoop receiver having a tension mechanism which holds the flange securely.

Other objectives and advantages of the present invention will become apparent to those skilled in the art as a more detailed description is presented below.

The present invention provides sewing apparatus consisting of a plurality of cooperatively joined sewing stations whereby each of said stations includes a sewing machine which is positioned above a table and each station includes a sewing machine head and a cylinder arm. The material to be sewed may be tubular such as a sweat shirt which is sandwiched in a framing hoop whereby the framing hoop can be positioned above the cylinder arm for sewing thereon in a hoop receiver having stanchions attached to a hoop drive mechanism. A hoop receiver is mounted on each side of the cylinder arm for maintaining the framing hoop in a releasable, fixed position during sewing. The stanchions are mounted below the cylinder arm on a means to move or drive the hoop as necessary to sew a particular pattern as is programmed in to a centrally located conventional motion controller. As the hoop driving mechanism moves in multiple directions during sewing, each of the framing hoops is likewise simultaneously moved under the needles of the sewing machine head whereby a number of garments can be identically stitched at one time. In order to control the motion of the hoops, programmable microprocessing circuitry as is conventional in the sewing machine art is utilized and is joined to the hoop drive mechanism.

DESCRIPTION OF THE PREFERRED EMBODIMENT

Figure 2:
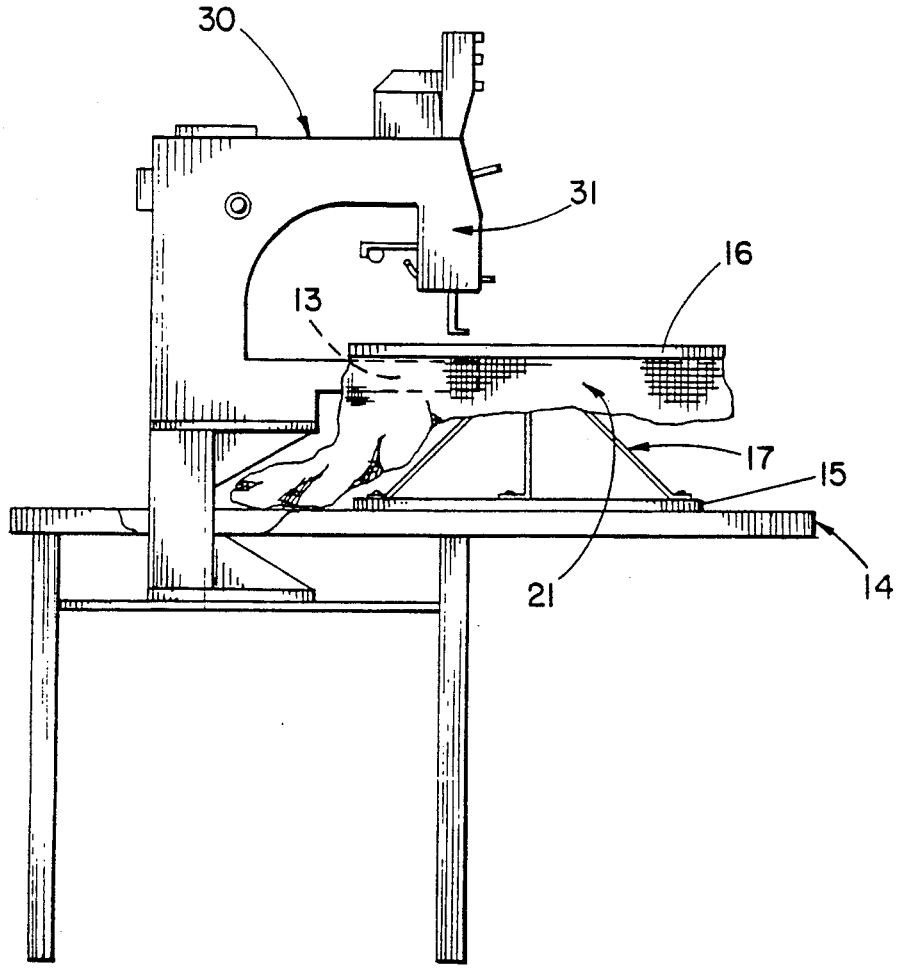
FIG. 2 illustrates a left side elevational view of one of the stations as shown in FIG. 1.

The preferred form of the sewing apparatus of the invention is shown in FIG. 2 whereby a sewing station includes a sewing machine head positioned vertically above a cylinder arm in raised fashion, above a sewing table. On the sewing table is a means to drive a framing hoop which is spaced below the cylinder arm to maintain and carry the excess material in the space of for example, a jacket during sewing. As further illustrated in FIG. 2, the cylinder arm of the sewing machine is substantially raised from the table to provide the needed space for the excess jacket material and means to drive the framing hoop is positioned on the table so the excess fabric material can extend below the framing hoop onto the table, out of the way of the moving framing hoop and hoop drive mechanism during the sewing or stitching operation. A framing hoop receiver consisting of a tension assembly and stanchion is attached to the hoop drive mechanism to allow the framing hoop to move in accordance with a preprogrammed pattern as set forth in the motion control means (not shown in FIG. 2). The framing hoop receiver maintains the framing hoop above the cylinder arm by engaging the outwardly extending framing hoop flanges.

The preferred form of the framing hoop includes an inner hoop having a pair of opposingly, outwardly extending flanges for engagement with an outer hoop, and the flanges are configured for ease in loading and unloading into the hoop receiver.

Figure 1:
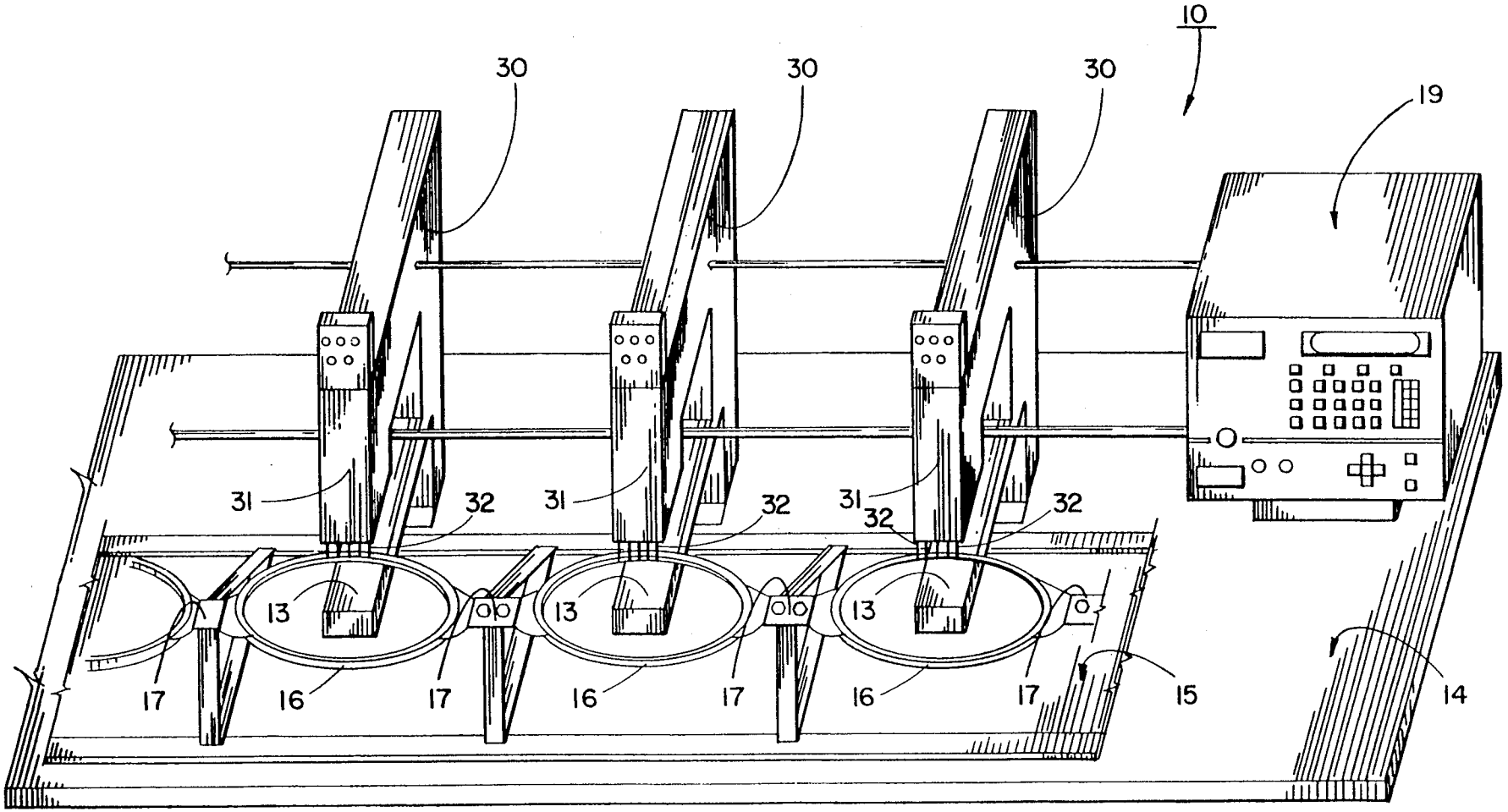
FIG. 1 demonstrates a front perspective view of sewing apparatus of the invention including a plurality of sewing stations.
Figure 3:
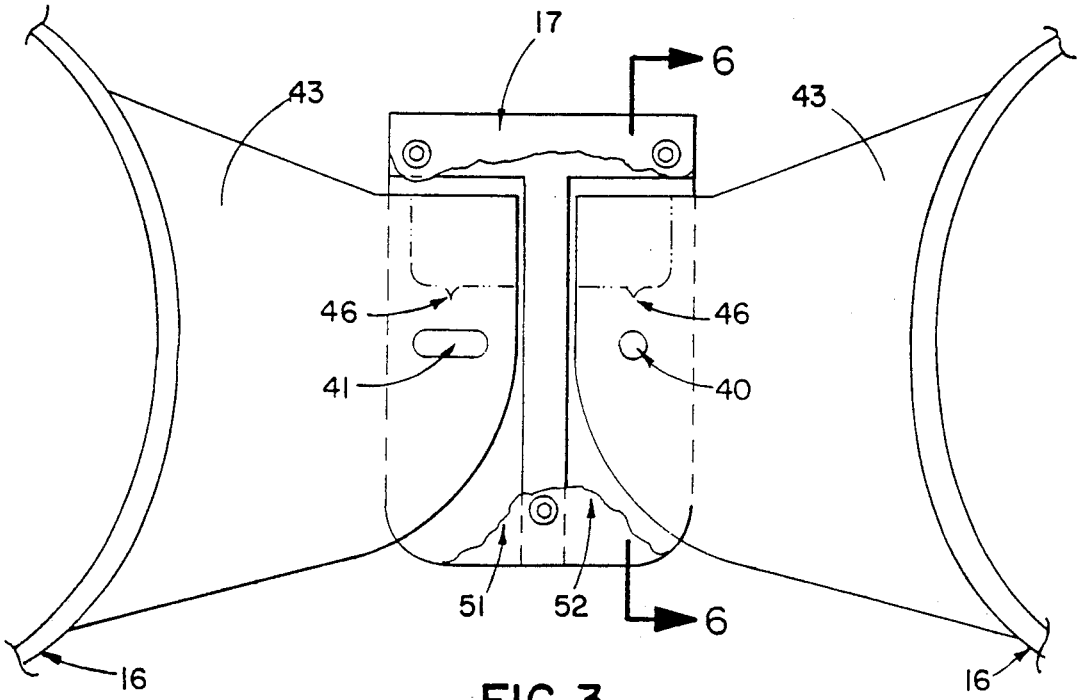
FIG. 3 demonstrates a top view of a hoop receiver with partial views of two framing hoops positioned therein.
Figure 4B:
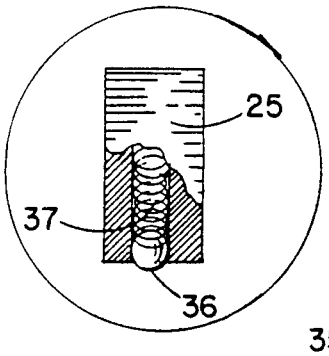
FIG. 4*b* shows an enlarged view of tension member (25)
Figure 4A:
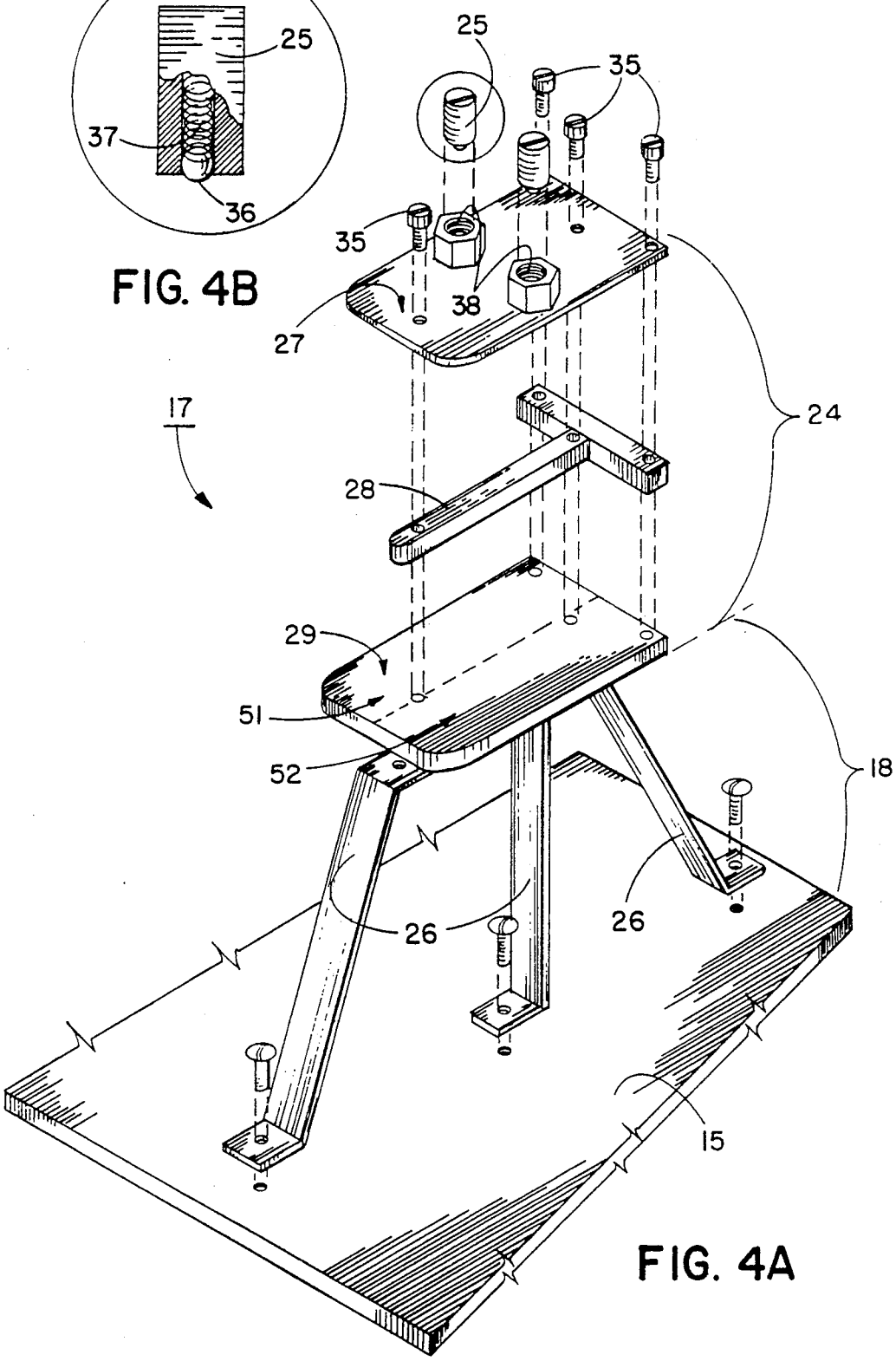
FIG. 4*a* illustrates an exploded view of the hoop receiver as shown in FIG. 3 with the framing hoops removed therefrom.

For more complete understanding of the invention and its operation, turning now to the drawings, FIG. 1 demonstrates sewing apparatus 10 having a plurality of sewing stations 11 which include sewing machine 30 with sewing head 31 having needles 32 therein. Sewing machine 30 is a conventional industrial sewing machine joined to a motion control means 19 for controlling sewing machines 30 in simultaneous fashion. As would be understood, motion control means 19 operates or controls driving means 15 which drives framing hoops 16, and extends from station to station in standard configuration for two (2) or more sewing stations. Hoop driving means 15 moves or is driven in accordance with preprogrammed motion control means 19 which includes conventional microprocessing circuitry and drive mechanisms (not shown). Framing hoop 16 is seen under sewing head 30 and a particular stitch or indicia can be sewn on garment 21 as seen in FIG. 2. Hoop receiver 17 provides a means to hold hoops 16 as seen in fixed alignment as illustrated in FIGS. 2, 3 and 4 and includes tension assembly 24 joined to stanchions 18 comprising a series of legs 26 as seen in FIG. 4. Tension assembly 24 is positioned vertically above hoop driving means 15 so framing hoop 16 is supported as required above cylinder arm 13. Cylinder arm 13 contains threaded bobbins (not shown), and is mounted to table 14. Sewing apparatus 10 as shown in FIG. 1 includes three (3) sewing stations but may include a larger or smaller number as is conventional in the sewing industry, depending on particular operation requirements. Large, bulky items such as sweat shirts, jackets or the like could not be easily accommodated and oftentimes cause jams and other mishaps when sewn at conventional sewing stations with cylinder arm 13 mounted at table top height, approximately the height of hoop driving means 15. However, with the construction and placement as shown in applicant's invention, cylinder arm 13 has been substantially raised above hoop driving means 15 and table 14 thereby allowing additional movement, space and convenience during sewing. Hoop driving means 15 is positioned on top of table 14 as previously mentioned and is directed by motion means 19 as shown in FIG. 1.

In FIG. 4, hoop receiver 17 is illustrated with tension assembly 24 shown in exploded fashion with upper plate 27, plate divider 28 and lower plate 29 separated for clarity. Bolts 35 hold tension assembly 24 together and attach it to stanchion 18. Divider 28 is T-shaped and forms two (2) compartments 51, 52 and allows the flanges of two (2) framing hoops to be inserted within receiver 17, one on each side of divider 28. Tension members 25 have spring loaded plunger spheres 36 which are urged outwardly by coil spring 37 and acts as means to hold framing hoops. Tension members 25 are threaded and are vertically adjustable within opening 38. Plunger sphere 36 is sized to releasably engage receiving ports 40 and 41 as seen in FIGS. 5 and 6.

In use, two piece framing hoop 16 as shown in FIG. 3 sandwiches or "frames" a desired size sewing area of a jacket, sweat shirt or other material therebetween, and for a six (6) work station apparatus, six (6) such framing hoops would be prepared and flanges 43 positioned within receivers 17 as shown in FIGS. 2 and 3.

Figure 5:
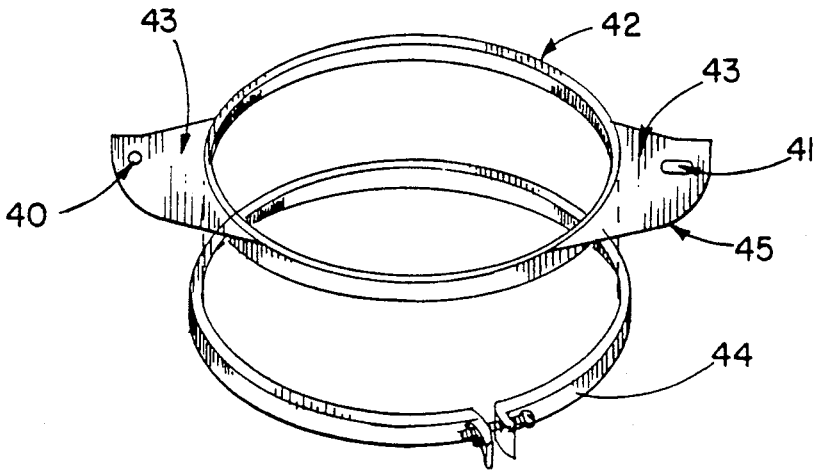
FIG. 5 depicts a framing hoop in separated, perspective fashion.
Figure 6:
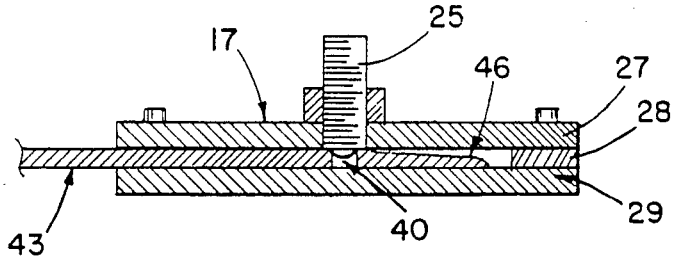
FIG. 6 shows a cross-sectional view of one of the flanges of the framing hoop along lines 6—6 as seen in FIG. 3.

FIG. 5 demonstrates framing hoop 16 having inner hoop 42 (with flanges 43) and outer hoop 44 which cooperatively engage for framing a desired area of cloth material or the like. Inner hoop alignment flanges 43 are planar and have a rounded rear corner 45. As further seen in FIG. 6, flange 43 includes a ramp portion 46 which allows sphere 36 (FIG. 4) to easily locate port 40 upon insertion into hoop receiver 17. Port 41 is elongated whereas port 40 is round and elongated port 41 allows for slight lateral movement of framing hoop 16 during loading and unloading procedures into hoop receiver 17. Corners 45 allow framing hoop 16 to be slightly rotated during loading and unloading into hoop receiver means 17 to aid the operator in "locking" framing hoop 16 in place within receiver 17.

In use, control means 19 can be programmed appropriately to stitch or sew numbers, names or the like within the work areas of the prepared framing hoops 16. After loading the framing hoops into hoop receivers 17, the operator can place the sleeves or other excess material on top of table 14 and upon hoop driving means 15 without fear of equipment jams as hoop driving means 15 moves through its various positions during sewing. Apparatus 10 is then activated by the operator and upon completion of the preprogrammed sewing pattern, framing hoops 16 are removed, and jackets 21 are disengaged from framing hoops 16. ANother series of jackets are placed within the framing hoops which are again loaded into hoop receivers 17 and the sewing pattern is continued for as many cycles as required.

Apparatus 10 as shown in FIGS. 1 and 2 provides ease and convenience of operation with little operator attention required during this sewing operation since the vertically spacing of cylinder arm 13 above table 14 diminishes the chances of jams and other mishaps.

The illustrations and examples provided herein are for explanatory purposes and are not intended to limit the scope of the appended claims.

I claim:

1. A framing hoop comprising a rim, a flange attached to said rim, said flange defining a tension member receiving port said flange defining a ramp, said ramp positioned forward of said receiving port away from said rim.

2. A framing hoop as claimed in claim 1 wherein said flange comprises a planar member.

3. A framing hoop as claimed in claim 1 and including a pair of flanges, said flanges opposingly positioned on said rim.

4. A framing hoop as claimed in claim 3 wherein said flange extends outwardly from said rim, one of said flanges defining a round tension member receiving port and the other of flanges defining an elongated tension member receiving port.

5. A framing hoop as claimed in claim 1 wherein said flange has a rounded rear corner.

6. A framing hoop for engagement with another hoop to form a material for sewing or embroidery thereon comprising: a rim, a pair of planar flanges, said flanges joined to said rim on opposite sides thereof, said flanges extending outwardly from said rim, one of said flanges defining a round tension member receiving port and the other of said flanges defining an elongated tension member receiving port, one of said flanges defining a ramp, said ramp positioned forward of said ramp receiving port away from said rim.

7. A framing hoop as claimed in claim 6 wherein both of said flanges define ramps, each of said ramps positioned forward of said receiving ports away from said rims.

8. Apparatus for releasably receiving a loaded framing hoop for sewing the material therein comprising: a stanchion, a tension assembly, said tension assembly joined to said stanchion, said tension assembly comprising means to hold the framing hoop on said stanchion.

9. Apparatus as claimed in claim 8 wherein said hoop holding means comprises a tension member.

10. Apparatus as claimed in claim 8 wherein said tension assembly comprises an upper plate, a divider, and a lower plate, said upper plate and said lower plate joined together to sandwich said divider therebetween.

11. Apparatus as claimed in claim 10 wherein said divider is T-shaped.

12. Apparatus for releasably receiving a framing hoop to hold the hoop while sewing on material framed therein comprising: a stanchion, a tension assembly, said tension assembly positioned on said stanchion, said tension assembly comprising:

(a) an upper plate, (b) a divider, (c) a lower plate said upper plate joined to said lower plate with said divider therebetween, and (d) means to hold a framing hoop whereby said divider separates said tension assembly into two compartments, each of said compartments for receiving said framing hoop.

13. Apparatus as claimed in claim 12 wherein said hoop holding means includes a tension member, said tension member joined to said upper plate.

14. Apparatus as claimed in claim 12 wherein said hoop holding means comprises adjusting means, said adjusting means affixed to said upper plate.

* * * * *